US005749036A

United States Patent [19]

Yoda et al.

[11] Patent Number: 5,749,036

[45] Date of Patent: May 5, 1998

[54] IMAGE FORMING APPARATUS WITH OIL SUPPLY CONSUMPTION PREDICTION

[75] Inventors: Kaneo Yoda; Hiroshi Tanaka, both of Nagano, Japan

[73] Assignee: Seiko Epson Corporation, Tokyo, Japan

[21] Appl. No.: 766,465

[22] Filed: Dec. 12, 1996

[30] Foreign Application Priority Data

Dec. 20, 1995 [JP] Japan ..... 7-332220

[51] Int. Cl.[6] ..... G03G 15/20

[52] U.S. Cl. ..... 399/325

[58] Field of Search ..... 399/324, 325, 399/67, 45; 118/60

[56] References Cited

U.S. PATENT DOCUMENTS 5,592,275 1/1997 Echigo et al. ..... 399/325

FOREIGN PATENT DOCUMENTS 59-35022 4/1978 Japan .

64-1032 5/1982 Japan .

*Primary Examiner*—S. Lee

*Attorney, Agent, or Firm*—Sughrue, Mion, Zinn, Macpeak & Seas, PLLC

[57] ABSTRACT

An image forming apparatus which has a structure such that the oil consumption in a detachable and changeable oil supply unit is accurately predicted in order to display appropriate change timing. This prevents continuation of a fixing operation when the fixing cannot be performed because oil has been consumed. The result is a reliable fixing operation in which offset is prevented. The oil consumption of a detachable oil supply unit is predicted using at least any one of size, material, and printing mode information. Oil consumption is used to calculate and predict the integrated value of the predicted oil consumption. If the integrated value of the predicted oil consumption exceeds a predetermined value, a message to change the oil supply is displayed. After the message has been displayed, the image forming apparatus is interrupted.

15 Claims, 6 Drawing Sheets

IMAGE FORMING APPARATUS WITH OIL SUPPLY CONSUMPTION PREDICTION

BACKGROUND OF THE INVENTION

1. Field of the Invention

The present invention relates to an image forming apparatus that applies an offset preventive solution so as more reliably provide for the fixing of images on a recording members, and that reliably prevents offset by accurately predicting the accumulated consumption of offset preventive solution.

2. Description of the Related Art

An image forming apparatus using an electrophotographic method fixes a monochrome or a multicolor toner image, that has been transferred to, or disposed on a recording member (such as paper), with a heat fixing unit that has a heated rotative member (for example, a pair of fixing rollers). In particular, such an apparatus fixes images on recording members by performing fixing operations.

The fixation of multicolor toner images requires special considerations. In particular, the fixation of a multicolor toner image must be performed so as sufficiently to melt and to deform the toner to develop colors satisfactorily. When fixing a multicolor toner image on an overhead projection transparency sheet (OHP sheet), the fixing operation must be performed so as to maintain the transmissivity of the transparent OHP sheet.

The special considerations of multicolor toner image fixation give rise to problems. A principal problem is known as the offset phenomenon. The offset phenomenon is characterized in that toner on the recording member adheres to the roller. The offset phenomenon is highly undesirable because the offset toner (i.e., the toner that adheres to the roller) causes image contamination. Moreover, the undesired adhesion of the offset toner often causes the recording member to be wound around the roller, thus causing a jam. Even worse, sometimes the thermistor of the image forming apparatus cannot be operated normally, and therefore smoke emanates from the fixing unit. The offset phenomenon may be referred to simply as "offset".

Offset can be avoided by applying an offset preventive solution, such as silicon oil, to the fixing unit. In particular, the oil is applied to a heated rotative member. Where the heated rotative member is a pair of fixing rollers, the silicon oil is applied to the roller surface. In view of the problems associated with the offset, phenomenon, the reliable application of oil is essential to the proper and safe fixing of a multicolor toner image on a recording member.

In an ideal oil application system, the oil applying apparatus does not make the image forming apparatus overly large, is easy for a user to change, and automatically signals the user that replacement is required. The timing of the signal should not be too soon (i.e., when there is oil that could still be used) or too late (i.e., when the oil has been depleted). A replaceable source of offset preventive solution is thus desirable.

Japanese Patent Laid-Open No. 1-29884 describes a large oil tank, a pump, an oil passage, an application unit, a limiting unit, an oil feedback passage, and the like. This large apparatus is intended to circulate oil in a large quantity.

In order to improve the maintenance characteristic and reduce the size and weight of an apparatus like the foregoing, a detachable offset preventive unit for applying offset preventive solution is disclosed in Japanese Patent Laid-Open No. 60-108871. In this detachable apparatus, the oil cassette and the oil-applying roller are detachable. This permits a user to change the cassette and the roller.

The reliable application of oil can involve controlling how much oil is applied, and when. A method for controlling how much oil is applied is disclosed in Japanese Patent Laid-Open No. 58-35569, in which the quantity of oil to be applied is changed depending upon the conveyance speed of the recording member. In Japanese Patent Laid-Open No. 60-51866, the timing at which the oil applying means applies the oil is varied depending upon the rotational speed of the fixing operation.

As regards determining when consumables that relate to an image forming apparatus are changed, Japanese Patent Laid-Open No. 61-185761 mentions the accumulation of information concerning the exposure time of an exposing unit (like a laser beam). When the accumulated exposure time has reached a predetermined level, a signal is provided that urges the user to change the process cartridge.

In Japanese Patent Laid-Open No. 1-29884, however, a serviceman must periodically inspect and to replenish the consumed quantity of oil. Such a maintenance characteristic is unsatisfactory. Moreover, the residual quantity of oil in the tank generally is required visually to be confirmed by a user to change the same. Therefore, the user must perform a complicated operation, the result of which is thus unreliable. Moreover, the oil supply is complicated and large scale, and mechanisms for applying and circulating the oil are required. This causes the fixing unit and the image forming apparatus to be excessively large.

Japanese Patent Laid-Open No. 60-108871 only deals with the mechanical structure that provides interchangeability of the replaceable parts, but is silent as to the life of the consumable parts and the timing of the change. That is, this document does not mention any basis upon which to replace the replaceable source of offset preventive solution.

Japanese Patent Laid-Open No. 58-35569 and Japanese Patent Laid-Open No. 60-51866 discuss only the quantity of oil to be applied, and the time at which oil must be applied. Neither of these two documents describe the life of the consumable parts or the timing of the change thereof. In other words, both of these documents fail to provide any basis on which the replacing of the oil source is to be made.

Japanese Patent Laid-Open No. 61-185761 mentions an approach to determining when a process cartridge should be changed based on exposure information. The process cartridge, however, is much different in character than a replaceable source of offset preventive solution, and much different considerations are involved. This document thus contains no teaching as to the life of an oil applying unit and the timing of the change thereof.

One approach to timing the change of the oil cartridge or the like is to perform a change once a certain number of sheets have been printed (i.e., after a predetermined number of fixing operations have been performed). Some products include such an instruction in their operations manual. Thus, a user generally is required to record and to confirm the total number of printed sheets. Alternatively, the user may simply wait until he detects a defect in printing, such as an offset image. Once the offset phenomenon is detected, the user then performs a change. In the former approach, too much depends on the user properly performing a too-complicated operation. The result of such an operation is inherently unreliable. In the latter approach, the timing of the change is too late, and the adverse effects of the offset phenomenon are not prevented.

The time at which the consumable and interchangeable oil applying unit must be changed has not previously been sufficiently considered. Many factors affect the consumption of oil, and replacing an oil source on the sole basis of the number of fixing operations performed gives inaccurate and inadequate results.

Prior to the present invention, no image forming apparatus has included a system that appropriately predicts and, hence, provides a proper basis for replacing a replaceable oil source. No image forming apparatus has included a system that properly urges the user to change the unit at an appropriate time. Using the inadequate approaches described above, users tend to change the oil source too early, even though it may have a longer useful life, and this results in an economical disadvantage. Users also tend to change the oil source too late, even though its useful life has expired. Thus, depending on the circumstances, jamming takes place when a recording member is wound around the roller, thus obstructing the normal operation of the fixing unit. Furthermore, continued use of the oil source beyond its useful life may result in the generation of smoke from the fixing unit, as already described.

SUMMARY OF THE INVENTION

In view of the foregoing, an object of the present invention is to provide an image forming apparatus having detachable and changeable oil supply means, capable of accurately predicting oil consumption and displaying a warning at an appropriate change time, and preventing continued fixing operations when the oil in the oil supply has been consumed.

An image forming apparatus according to the present invention includes image forming means for forming a toner image on an electrostatic latent image holding member; transfer means for transferring the toner image onto a recording member; fixing means for fixing the toner image to the recording member by a heated rotational member; paper feeding means for feeding the recording member; and a recording member conveyance passage for introducing the recording member into the transfer means and the fixing means, wherein the fixing means has oil supply means and there are provided calculating means for calculating, with respect to instructed or detected information of the number of the recording members, predicted oil consumption by using at least any one of instructed or detected size information of the recording member, instructed or detected material information of the recording member, printing mode information denoting whether single sheet printing or continuous printing is performed, and color mode information denoting whether a single color mode or plural color mode is performed, integrated value storage means for integrating the predicted oil consumption to store integrated values of the predicted oil consumption, comparison means for comparing the integrated value of the predicted oil consumption with a predetermined value, and output means for transmitting a switch signal of the oil supply means when the integrated value of the predicted oil consumption have exceeded the predetermined value.

An image forming apparatus according to the present invention is characterized in that the integrated value of the predicted oil consumption is expressed by:

$$W=\sum_{i=1}^{n} wi=\sum_{i=1}^{n} ai\times(si\times ci+(bi-si)\times d)$$

where

W=integrated value of the predicted oil consumption (mg)

n=total number of the fed recording members, i=number of the fed recording members, wi=predicted oil consumption when i-th recording member is fed, ai=amount (mg/cm$^2$) of applied oil per unit area of the fixing means which is switched in accordance with whether the monochrome printing or multicolor printing is performed, si=area of the recording member (cm$^2$), bi=area applied with oil (cm$^2$), ci=oil absorption rate of the recording member, d=oil evaporation rate.

An image forming apparatus according to the present invention is characterized in that the comparison means has first comparison means and second comparison means, the predetermined value includes a first predetermined value and a second predetermined value, the output means has first output means and second output means, the first comparison means compares the integrated value of the predicted oil consumption with the first predetermined value, the first output means transmits a signal for switching the oil supply means when the integrated value of the predicted oil consumption have exceeded the first predetermined value, oil switch display means operates a display portion, the second comparison means compares the integrated value of the predicted oil consumption with the second predetermined value, the second output means transmits a signal for interrupting the image forming apparatus when the integrated value of the predicted oil consumption have exceeded the second predetermined value, and interruption means interrupts the image forming apparatus.

An image forming apparatus according to the present invention further comprises resetting means for detecting switch of the oil supply means after the operation of the image forming apparatus has been interrupted to reset the integrated value of the predicted oil consumption and enabling operation of the image forming apparatus.

DETAILED DESCRIPTION OF THE PREFERRED EMBODIMENTS

Figure 1:
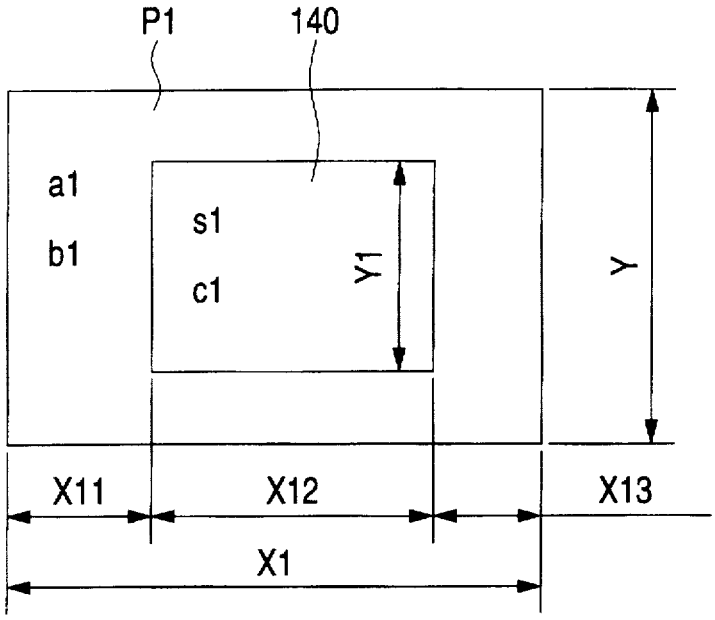
FIGS. 1(*a*) and 1(*b*) is a view of explanatory showing oil consumption in an image forming apparatus according to the present invention.
Figure 1:
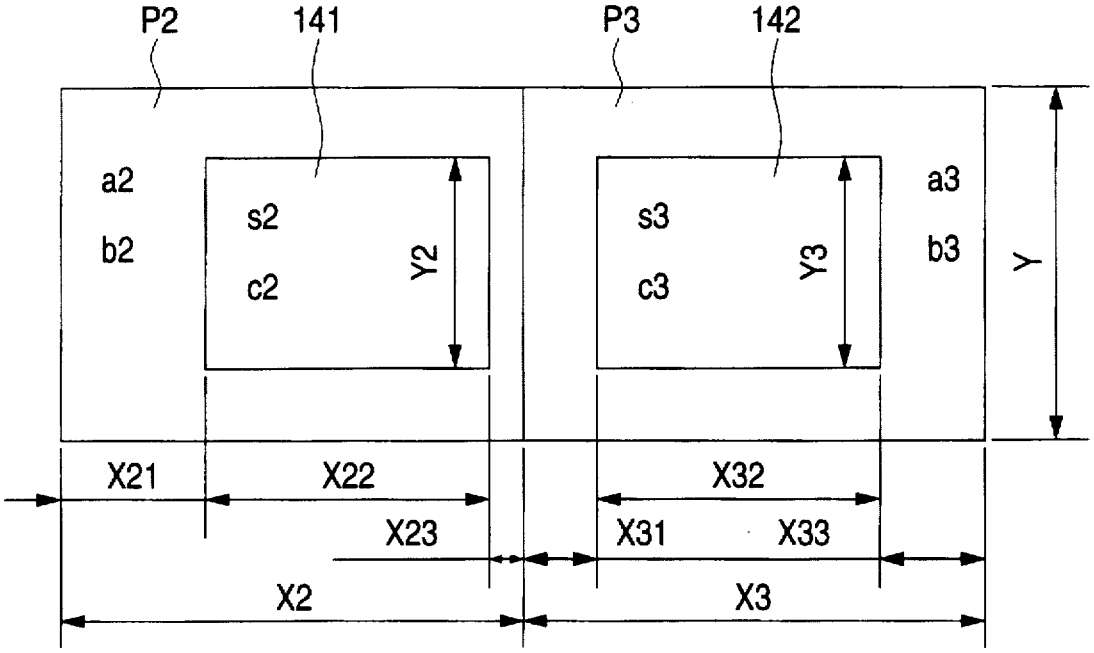

Embodiments of the present invention will now be described with reference to the drawings.

Presently, a description will be provided regarding the prediction of oil consumption for a given fixing operation, and the use of such a prediction in timing the change of an oil supply. In the following discussion, an example is used in which the fixing operation is conducted with a heating roller. Of course, the example is meant merely to be descriptive, and the invention is applicable in other contexts, as will be readily appreciated by one of skill in the art.

In the first exemplary embodiment, fixing is accomplished with a heat roll. The fixing unit, therefore, comprises a heating roller having heating means, a pressurizing roller for pressing the heating roller to form a nip portion, oil supply means for applying offset preventive solution, such as silicon oil, to the surface of the heating roller in an appropriate quantity, and oil limiting means for forming a uniform thin film of the applied oil.

Non-fixed toner is disposed on a recording member, and brought into contact with the surface of the heating roller. The heating roller heats the toner and fixes it to the recording member. The surface of the heating roller is supplied with an offset preventive solution, such as silicon oil, so as to have a predetermined width to easily separate the surface of the roller from the toner.

The oil does not permanently stay on the heating roller, but is consumed during operations. The amount and rate of oil consumption depends on a variety of factors.

One of the factors affecting oil consumption includes the quantity of applied oil. If only a little oil is applied to the roller, consumption is less than if a greater amount of oil is applied.

Another factor is the quantity of oil absorbed by the recording member. Oil absorbed by a recording member is oil consumed. The size of the recording member is important, because a larger recording member will absorb more oil than a smaller recording member of the same composition. The composition of the recording member is important, because a recording member like paper will absorb more oil than a recording member made of OHP film. Since the image forming apparatus may be used for recording members of varying sizes and compositions, this factor cannot be ignored.

An additional factor bearing on oil consumption is the particular type of printing operation and, in particular, the toner used. Printing with multicolor toner consumes more oil than monochrome toner. When the toner disposed on the recording member is multicolor toner, the quantity of oil applied must be increased so as to prevent offset. Less oil is required to prevent offset when fixing monochrome toner.

A further factor for consideration in predicting oil consumption is whether a printing operation is successive or single (i.e., whether the printing mode is multiple or single). That is, oil consumption varies depending on whether a particular printing operation is immediately preceded by another printing operation or is preceded, instead, by an idle period.

To explain further, prior to the actual fixing of toner on a recording member, the roller of the fixing unit is rotated during what is known herein as a "previous idling period". During the previous idling period, the temperature of the roller is raised, and the recording member is fed. After the previous idling period, the recording member is heated in the nip. The discharge of the recording member, similarly, constitutes a second idling period. Assume a first printing operation occurs after an idle period of the image fixing apparatus. The first-printed sheet has a respective "previous idling period" and a respective "second idling period". Those periods for the first-printed sheet are different than the respective previous and second idling periods of a sheet on which a fixing operation is immediately thereafter performed.

Oil is consumed during the previous and the second idling periods, but a different amount is consumed depending on the length of each period. In accordance with the length of the oil applying period, oil is consumed because the oil is evaporated and absorbed by the pressuring roller.

In view of the foregoing factors, it is clear that the oil consumption of each particular fixing operation must be taken into account so as accurately to predict the overall oil consumption, and the timing with which the change of oil supply must be performed. In other words, in order to accurately predict oil consumption in the detachable interchangeable oil supply means, consumption per sheet must be considered to integrate the predicted oil consumption for each sheet.

First, the quantity of oil to be applied per unit area will be considered. This will be represented throughout the discussion by ai ($mg/cm^2$). Here, it is pointed out that i indicates the serial number of the i-th recording member fed. In other words, the first recording member would correspond to i=1. The second recording member would pertain to i=2, and so on. It is noted that i continues to increase until the oil supply is changed.

In a case where a color image is formed by toners in plural colors, a large quantity of toner is used. Since each toner is sufficiently melted, deformed and mixed to maintain its color developing characteristic, multicolor toner is much more easily offset compared with monochrome toner; multicolor toner also adheres much more easily to the heating roller. Therefore, oil must uniformly and continuously be applied in a relatively large quantity per unit area (ai). It is preferable that the quantity of oil to be applied per unit area be set so that, for an i-th fixing operation, if multicolor fixing is employed, $0.016 <= ai <= 0.08$ ($mg/cm^2$).

Monochrome toner image operations are characterized by relatively smaller amounts of toner. Also, the fixing strength must be maintained. In monochrome toner image operations, therefore, offset and adhesion are comparatively less likely to take place. Thus, oil is required to be applied in only a small quantity. It is preferable that the quantity of oil to be applied per unit area be set so that, for an i-th fixing operation, if monochrome fixing is used, $0.0016 <= ai <= 0.008$ ($mg/cm^2$).

Color mode information denotes whether the image to be fixed on the recording member is monochrome (i.e., single color mode) or multicolor (i.e., plural color mode). Color mode information may be obtained from color image information supplied from the host computer, or it may be provided via an instruction switch of the image forming apparatus, or it may be detected by the image forming means. In accordance with color mode information above, the oil supply means and the oil limiting means are appropriately controlled so as to properly provide the quantity ai ($mg/cm^2$) of oil to be applied per unit area. Particular numerical values, such as 0.08, 0.016, and the like are read, in this embodiment, from a ROM or some similar memory. The numerical values are thus readily available for use in the later-described calculation of the predicted oil consumption.

Second, the size and material of the recording member will be considered. In the discussion, the area of the i-th recording member in square centimeters will be denoted by si ($cm^2$). The oil absorption rate of the material of the i-th recording member will be indicated by ci.

In the image forming apparatus and the fixing unit, images are first printed on recording members having various sizes, and the images are subsequently fixed. Different recording member types have different recording member material content. Examples of commonly-used recording member types are paper, which easily absorbs oil, and a transparent OHP sheet made of resin, which does not absorb oil so easily. Assuming that the area of the i-th recording member is si ($cm^2$), and that the oil absorption rate is ci, the oil consumption attributable to absorption occurring when the i-th recording member is allowed to pass is a number of milligrams calculated by (ai×si×ci).

When the material is paper (plain paper, thick paper, thin paper, envelope and post card), ci is substantially 100%. In the case of a transparent OHP sheet, ci is substantially 50%. This decreased absorption results because absorption attributable to the capillary phenomenon does not take place as it does in paper.

Size information of the recording member may be obtained from color image information supplied from the host computer. It also may be provided via an instruction switch of the image forming apparatus, or it may be detected by a means for detecting the recording member in the image forming apparatus. By using information about the size of the recording member, the area si of the i-th recording member may be read from a ROM or the like so as to be used in the below-described calculation.

Information relating to the material of the recording member (i.e., material information) may be obtained from color image information supplied from the host computer, or may be instructed with an instruction switch of the image forming apparatus, or further may be detected by material detection means in the image forming apparatus. By using information about the material of the recording member, the corresponding oil absorption rate ci may be read from the ROM or the like so as to be used in the below-described calculation.

Thirdly, the oil consumption determined by the time for which oil is applied, and timing will now be considered. During this discussion, bi will indicate the area of the roller, in $cm^2$, to which oil is applied, and d will represent an evaporation rate of the oil used. As will become evident, some of the oil applied to the roller comes into contact with the recording member, and some does not.

Before the recording member is supplied to the heating nip portion, the fixing means must perform a previous idling operation to raise the temperatures of the heating roller and the pressurizing roller, and to rotate the heating roller in synchronization with the operation of the paper conveyance system from the paper feeding portion. This is often necessary because the drive means is the same. After the recording member has passed through the heating nip, a second idling operation must be performed in which the heating roller is rotated for a predetermined time to discharge the recording member or to wait a next printing signal.

In general, the oil supply means continues the oil applying operation in the foregoing period. Although the operation of the oil supply means and the oil limiting means are controlled to supply/limit oil in only a period substantially corresponding to a period in which the recording member is allowed to pass through the heating nip, the heating roller is coated with oil in a region from the oil supply portion to the nip portion. Therefore, periods corresponding to the previous idling operation and second idling operation are required though each period is very short. During the previous idling operation and the second idling operation, and in a case where the width of the recording member is small, oil in the regions not contacting the recording member is heated to a high temperature, and evaporated and consumed in a predeterminable quantity. Thus, even though some oil is applied to the roller but does not come in contact with a recording member, that oil is nevertheless eventually consumed through evaporation.

That is, the product of an area obtained by subtracting the area si ($cm^2$) of the i-th recording member from the oil applying area bi ($cm^2$) of the i-th recording operation represents the oil consumed through evaporation. Note that the oil evaporation rate is expressed by d which, in this embodiment, is substantially 0.3% because dimethylsilicon oil (viscosity: 300 to 100000 cSt) is used.

As discussed above, the previous idling operation and the second idling operation for the i-th recording operation differ based on whether the image forming apparatus performs a single sheet recording operation or a successive recording operation. Thus, the oil consumed through evaporation will depend on whether single sheet printing or continuous printing is performed.

Printing mode information indicates whether single sheet printing or continuous printing is performed. Successive printing operation is performed if a next printing command has been supplied from the host computer during the second idling operation or if a copying mode is selected. In this case, the period of the previous idling operation is shortened.

The difference with respect to the previous and second idling periods will become more clear from the following description, taken with reference to the drawings.

FIGS. 1(*a*) and (*b*) are explanatory views showing oil consumption in an image forming apparatus according to the present invention. The oil layer applied onto the heating roller is developed in the circumferential direction, and the quantity of oil which is consumed attributable to the passage of the i-th sheet is considered. For explanatory purposes, the surface area of the roller is depicted as an imaginary, continuous plane P. Assuming that the oil layer is in the form of an imaginary oil applied plane P, the oil application width is Y, and the oil application distance, or length, is X.

FIG. 1(*a*) shows oil consumption when the image forming apparatus according to the present invention performs a single sheet printing operation (i.e., operates in single printing mode). When the very first sheet of all is printed, the paper supply order of the recording member 140 is such that i=1. In other words, the current fixing operation is being performed on the i-th recording member, where i=1.

Thus, an imaginary oil applying plane P1 is considered. The oil supply means and the oil limiting means cause oil to be applied to form a uniform and thin layer on the heating roller with a width (in the axial direction of the heating roller) of Y (cm) and over a distance X1 (cm) at an oil applying quantity a1 ($mg/cm^2$) per unit area of the fixing unit. As for a1, the actual oil applying state is switched in accordance with color mode information denoting the printing mode as the monochrome printing mode or the multicolor printing mode. Moreover, the numerical value for a1 is read from the ROM or the like. As for the printing mode information that denotes whether the single sheet printing is performed or whether the successive printing operation is performed, the single sheet printing is performed in this example with i=1.

Therefore, in accordance with a predetermined sequence for the single sheet printing, the fixing unit first applies oil to the heating roller in the previous idling operation period represented by oil application distance X1 (cm). The fixing unit second applies oil to the heating roller in the period during which the recording member passes through the heating nip, as represented by oil application period (or distance) X12 (cm). Third, the fixing unit applies oil to the heating roller during the second idling operation period, which is represented by X13 (cm). The period X1, which represents the distance over which oil is applied to the roller during the previous idling period, the heating nip period, and the second idling period, is simply X1 (cm)=X1+X12+X13.

Moreover, the fixing unit calculates or detects X1 and calculates or calls the oil applied area b1 ($cm^2$)=X1×Y from the ROM or the like. In accordance with instructed or detected size information of the recording member 140, the oil applied area s1 ($cm^2$) is called from the ROM or the like. Similarly, in accordance with the instructed or detected material information of the recording member 140, the oil absorption rate c of the recording member is called from the ROM or the like. Moreover, the oil evaporation rate d has previously been stored. In addition, calculating means, such as a CPU, calculates the predicted oil consumption, which may be referred to as the current recording member oil consumption prediction. That is, the predicted oil consumption w1 (mg). for printing of the first sheet (i.e., i=1) is calculated as w1=a1×(s1×c1+(b1−s1)×d), and then the result is stored. Moreover, w1 is stored as an initial value in the integrated value storage means for storing integrated values of the predicted oil consumption.

In other words, the i-th recording member is being subjected to the current fixing operation, and a currently consumed amount of oil is determined. This currently consumed amount (w1) is accumulated into the value W, which represents an integrated, or total consumption value (presently consisting only of w1).

FIG. 1(*b*) shows oil consumption when the image forming apparatus according to the present invention performs an operation for successively printing two sheets (i.e., operates in continuous printing mode). Here, recording members i=2 and i=3 are printed. When member i=2 is printed, it becomes the current recording member and, understandably, is referred to as the subject of the current fixing operation. Member i=3 is printed after member i=2, and thus replaces i=2 as the current recording member that is the subject of the current fixing operation.

Since the second and third sheets are printed, the paper supply orders of the recording members 141 and 142 correspond to i=2, 3. Thus, imaginary oil applying planes P1 and P2 are considered.

The oil supply means and the oil limiting means cause oil to be applied to form a uniform and thin layer on the heating roller to have a width (in the axial direction of the heating roller) of Y (cm) and distances X2 and X3 (cm) in applying oil at respective quantities a2 and a3 (mg/$cm^2$) per unit area of the fixing unit which is switched depending upon whether the single sheet printing operation is performed or the successive printing operation is performed. As for a2 and a3, the actual oil applying state is switched in accordance with color mode information denoting the printing mode as the monochrome printing mode or the multicolor printing mode. Moreover, numerical values of a2 and a3 are read from the ROM or the like. As for printing mode information denoting whether the single sheet printing is performed or the successive printing operation is performed, the successive sheet printing is performed when i=2, 3.

Therefore, in accordance with a predetermined sequence for the successive printing, the fixing unit applies oil to the heating roller in: (1) the previous respective idling operation periods X21 and X31 (cm), (2) periods X22 and X32 (cm) in which the recording member is allowed to pass through the heating nip, and (3) the second idling operation periods X23 and X33 (cm).

Period X2 is, therefore, X2 (cm)=X21+X22+X23, and period X3 is therefore X3 (cm)=X31+X32+X33. The second idling operation period X23 of the sheet i=2, and the previous idling operation period X31 of the sheet i=3, respectively, are set to be shorter than similar periods in the single sheet printing.

Moreover, X2 and X3 are calculated or detected so as to calculate the oil applied area b2 ($cm^2$)=X2×Y and b3 ($cm^2$) =X3×Y, or are called ROM or the like. On the other hand, in accordance with instructed or detected size information of the recording members 141 and 142, the recording member areas s2 and s3 ($cm^2$) are called from the ROM or the like. Similarly, in accordance with the instructed or detected material information of the recording members 141 and 142, the oil absorption rates c2 and c3 of the recording members are called from the ROM or the like. Moreover, the oil evaporation rate d has previously been stored. In addition, calculating means, such as a CPU, calculates the predicted oil consumption. That is, the predicted oil consumption w2 (mg) for printing the second sheet (i=2) is calculated as w2=a2×(s2×c2+(b2−s2)×d), and then the result is stored. In other words, when the recording member i=2 is the current recording member, the currently consumed amount is determined to be w2.

Then, the predicted oil consumption is integrated and the integrated value of the predicted oil consumption W (mg) is calculated. That is, W becomes equal to W+w2, or w1+w2. The value for W is updated and stored as the integrated value of the predicted oil consumption in the integrated value storage means. In particular, the currently consumed amount w2 is added to the earlier integrated consumption value W. Thus, the respective currently consumed amount of oil is accumulated over each fixing operation to provide an integrated consumption value.

Similarly, predicted oil consumption w3 (mg) for printing the third sheet (i=3) is calculated as w3=a3×(s3×c3+(b3−s3)×d) and the result is stored. Then, the predicted oil consumption is integrated and the integrated value of the predicted oil consumption W (mg) is calculated. Thus, W becomes equal to W+w3, or w1+w2+w3. The value W is updated and stored in the integrated value storage means as the integrated value of the predicted oil consumption.

By repeating the foregoing sequential operation for every fixing operation, the integrated value of the predicted oil consumption for the total number of recording members which have been supplied is calculated in accordance with the following numerical formula:

$$W=\sum_{i=1}^{n} wi=\sum_{i=1}^{n} ai\times(si\times ci+(bi-si)\times d)$$

where

W=integrated value of the predicted oil consumption (mg)

n=total number of the fed recording members, i=number of the fed recording members, wi=predicted oil consumption when i-th recording member is fed, ai=amount (mg/$cm^2$) of applied oil per unit area of the fixing means which is switched in accordance with whether the monochrome printing or multicolor printing is performed, si=area of the recording member ($cm^2$), bi=area applied with oil ($cm^2$), ci=oil absorption rate of the recording member, d=oil evaporation rate.

The life of the oil supply means depends also on the amount of oil it contains (i.e., the supplied amount of the replaceable source). Pertaining to the oil supply means is a stored, predetermined value in accordance with the life thereof. That is, in a case of an oil applying roller, the actual quantity of oil is included in a range from 20,000 to 100,000 (mg) though it depends upon the size of the roller. In the present exemplary embodiment, 100,000 (mg) is previously set to the CPU as a predetermined value (i.e., as the supplied amount). For example, when the printing operation has been completed, the comparison means, such as a CPU, compares the integrated value of the predicted oil consumption W and the predetermined value, and the output means transmits a change signal, such as an alarm sound, for notifying the user of the change of the oil supply means when the integrated value of the predicted oil consumption W has exceeded the predetermined value, the oil change display means operates the display portion to urge the user quickly to change it.

Although the foregoing embodiment takes advantage of substantially all key information (i.e., the size information of the recording member, the material information of the recording member, the printing mode information denoting single or successive sheet operation, and the color mode information denoting monochrome or multicolor operation) to predict the integrated value of the predicted oil consumption. In this case, the most accurate prediction can be performed.

A second embodiment will now be described which uses less information than the first embodiment. The particulars of this second embodiment are exemplary, and it will readily be appreciated that variations are possible.

That is, a subset of the total information (i.e., at least any one of size information of the recording member, material information of the recording member, printing mode information denoting whether the single sheet printing operation or the successive printing operation is performed and color mode information denoting whether the monochrome printing operation or the multicolor printing operation is performed) may be used with respect to information about the number of the recording members to predict the integrated value of the predicted oil consumption. In other words, this embodiment of the invention illustrates that a satisfactory prediction accuracy can be obtained even though less than all of the available information is used.

For example, prediction of the integrated value of the predicted oil consumption may be carried out by using, for each recording member passed, the size information of the recording member (i.e., si), and the color mode information denoting monochrome or multicolor operation (relating to ai). Using only such information for each recording member results in the integrated value of the predicted oil consumption being simplified, as expressed by the following numerical formula.

$$W = \sum_{i=1}^{n} wi = \sum_{i=1}^{n} ai \times si$$

where

W=integrated value of the predicted oil consumption (mg)

n=total number of the fed recording members, i=number of the fed recording members, wi=predicted oil consumption when i-th recording member is fed, ai=amount (mg/cm$^2$) of applied oil per unit area of the fixing means which is switched in accordance with whether the monochrome printing or multicolor printing is performed, si=area of the recording member (cm$^2$), In this example of an image forming apparatus according to the second embodiment, the prediction accuracy is satisfactory for practical use.

An exemplary structure incorporating the image forming apparatus according to the present invention will now be described with reference to FIG. 2 and FIG. 3.

Figure 2:
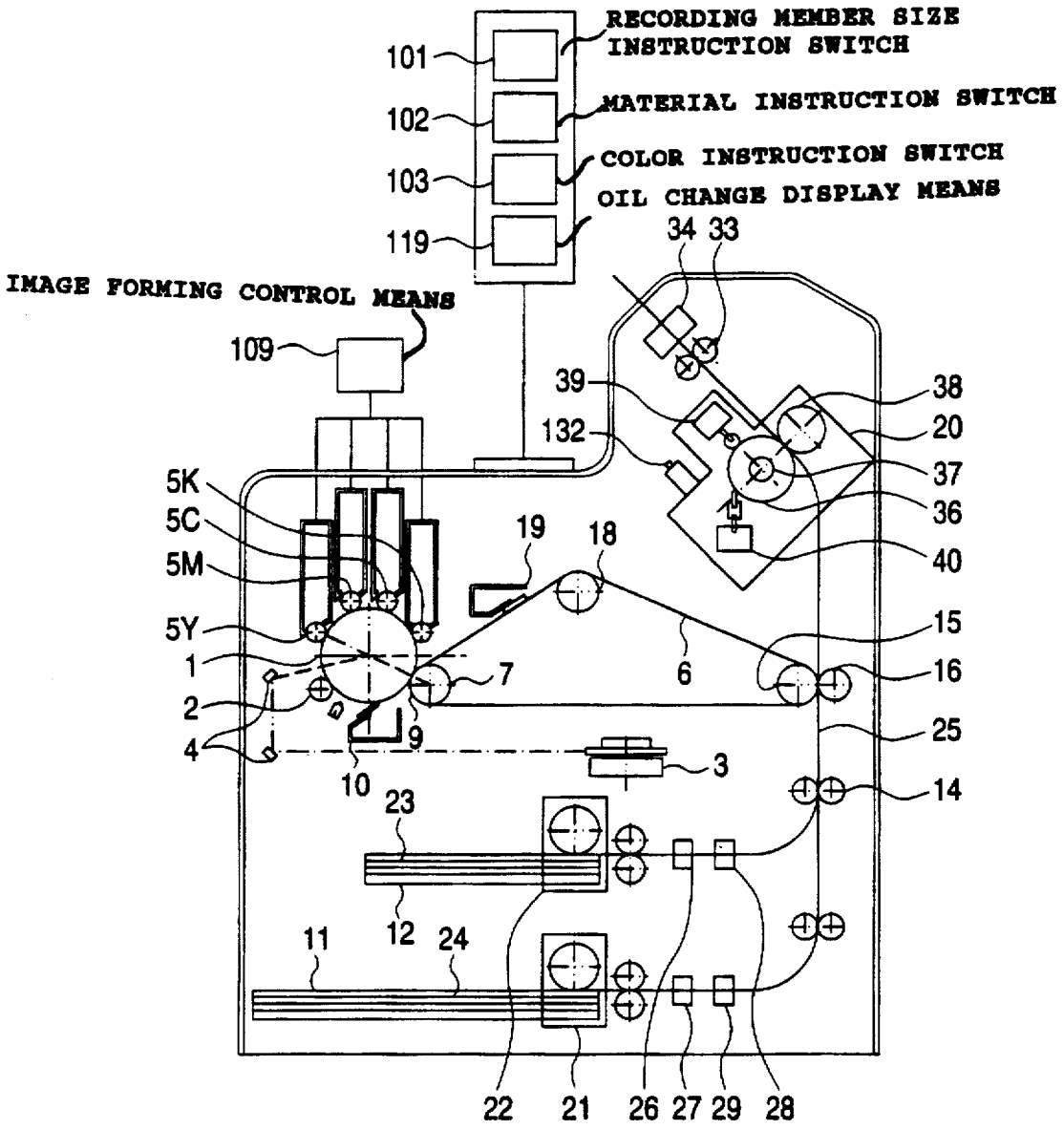
FIG. 2 is a schematic cross sectional view showing the image forming apparatus according to the present invention.
Figure 3:
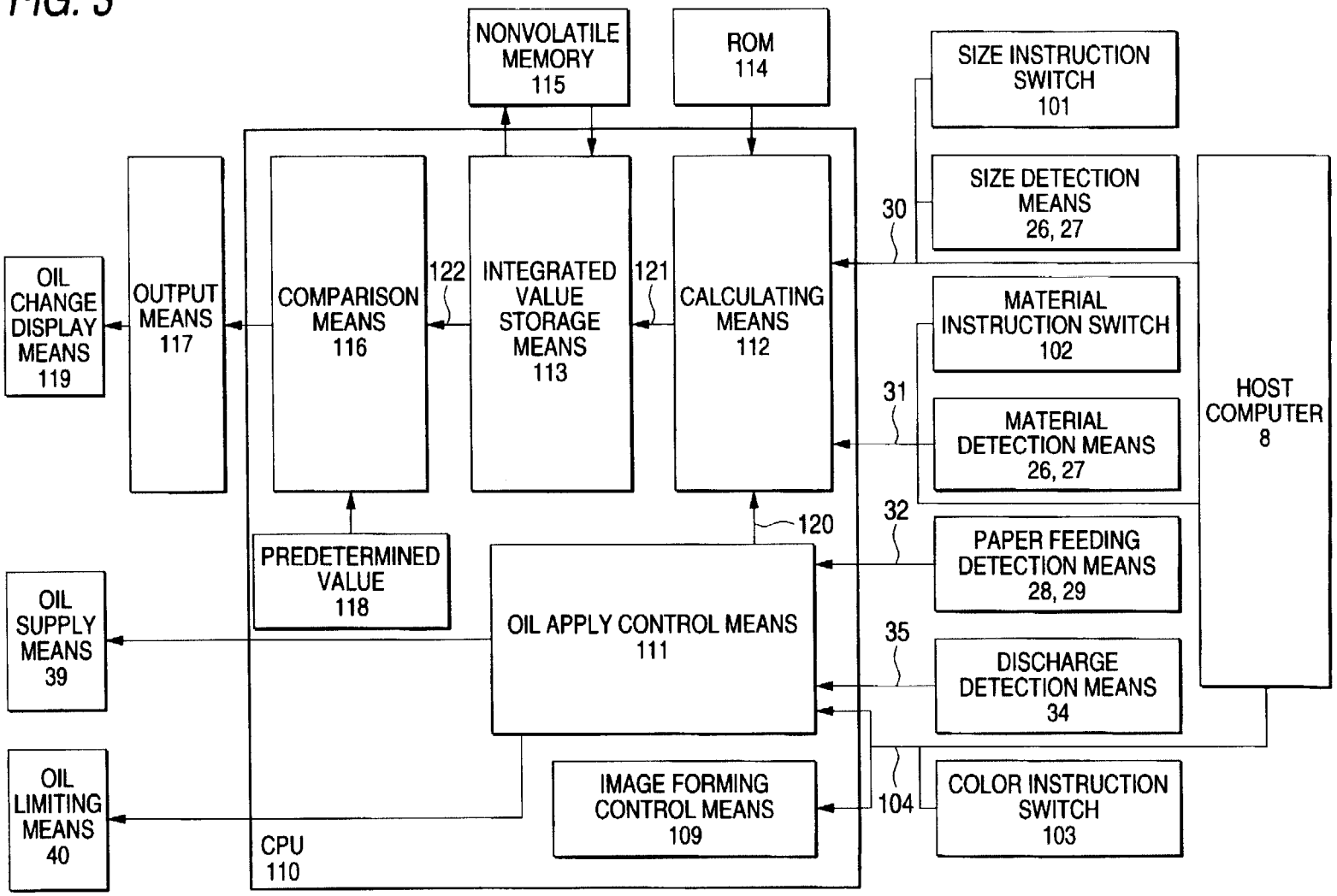
FIG. 3 is a block diagram showing the structure of the present invention.

FIG. 2 is a schematic cross sectional view showing the image forming apparatus according to the present invention. FIG. 3 is a block diagram showing the structure of the present invention. In the following discussion, reference will be made to items shown in either of both of FIGS. 2 and 3.

An image forming means for forming a toner image on an electrostatic latent image holding member 1 will now be described. Charging means 2, such as a charging roller, electrically charges the electrostatic latent image holding member 1, such as a photosensitive member, to have a uniform and certain potential (for example, −700 V). A laser beam formed by exposing means 3, such as a laser scanning optical system, and having a resolution of 600 dpi (dot per inch) is, by a return mirror 4, introduced onto the electrostatic latent image holding member 1 so that an electrostatic latent image is formed. Image information supplied from a host computer 8 or color mode information 104 denoting whether the monochrome printing operation or the multicolor printing operation is performed and instructed by a color instruction switch 103 provided for the image forming apparatus is supplied to oil application control means 111 of a CPU 110. Image forming control means 109 follows a predetermined sequence to bring a yellow developing unit 5Y among one-component type developers 5 arranged to be brought into contact with and separated from toner while separating the other developing unit. Moreover, an effect of an electric field generated by a power source (not shown) causes yellow toner charged positively is reversed and developed so as to be converted into a visible image on the electrostatic latent image holding member 1. The yellow toner forming the visible image is moved to a nip portion formed by an intermediate transfer member 6 to have an appropriate resistance by dispersing carbon in ETFE (ethylene-tetrafluoroethylene copolymer) and a primary transfer roller 7. A primary transfer power source (not shown) capable of controlling a constant electric current applies a bias having a polarity opposite to that of the toner. As a result of the effect of the electric field the bias, the toner is transferred onto the intermediate transfer member 6. The residual toner on the electrostatic latent image holding member 1 is recovered by a photosensitive member cleaner 9 having a blade which is brought into contact with the surface of the electrostatic latent image holding member 1 for cleaning the surface. Then, the potential of the photosensitive member is reset by a destaticizing lamp 10. A similar operation is performed for a magenta developing unit 5M, a cyan developing unit 5C and a black developing unit 5B in synchronization with the position of the intermediate transfer member 6 and the light emission timing of the exposing means 3. As a result, colors of the respective colors are stacked on the intermediate transfer member 6 so that a full color image is formed. During this, transfer means 16, such as a secondary transfer roller, and an intermediate transfer member cleaner 19 are brought to a separated state. On the other hand, a recording member 13, such as paper, is conveyed from paper feeding means 11, such as a paper feeder cassette, to a resist roller pair 14, and then, in synchronization with a full color image on the intermediate transfer member 6, the recording member 13 is conveyed to a secondary transfer portion realized by transfer means 16 capable of being brought into contact with a drive roller 15 and separated from the same. In the secondary transfer portion, the transfer means 16 is brought into contact with the intermediate transfer member 6 in synchronization with the recording member 13 so as to form a nip portion. A secondary transfer power source (not shown) controls constant voltage so that the effect of its electric field causes a full color toner image to be formed on the recording member 13. At this time, the intermediate transfer member cleaner 19 is brought into contact with the intermediate transfer member 6. Then, the recording member 13 is fixed by fixing means 20, and then discharged to the outside of the apparatus. Residual toner after the secondary transference has been performed is allowed to pass through a tension roller 18, and then recovered by the intermediate transfer member cleaner 19.

Then, feeding of the recording member 13 and the conveyance method will now be described. The image forming apparatus has a plurality of paper feeding means 11 and 12 which respectively store recording members 13 having different sizes. The paper feeding means 11 includes transparent OHP sheets 24, while the paper feeding means 12 includes envelopes 23. The paper feeding means 11 and 12 respectively are provided with size detection means 21 and 22 for detecting the size of the recording member to detect the sizes, such as A3, A4 and envelope, to transmit size information 30 of the recording member to a CPU 110 in the image forming apparatus. In accordance with size information 30 supplied from the host computer 8 or instructed by a recording member size instruction switch 101 provided for the image forming apparatus, control means of the image forming apparatus selectively operates the paper feeding means 11 or 12 to feed the recording member 13 having the predetermined size to a recording member conveyance passage 25. The conveyance passage from the paper feeding means 11 and 12 to discharge through the fixing means 20 is made to be recording member conveyance passage 25. Material detection means 26 and 27 for detecting the material of the recording member are disposed adjacent to the paper feeding means to detect the material, such as the plain paper and the transparent sheet so as to transmit material information 31 of the recording member to the CPU 110 in the image forming apparatus. The material detection means 26 and 27 comprise, for example, photocouplers to determine whether the sheet is a transparent sheet or plain paper in accordance with light transmission. Moreover, information supplied from the host computer 8 or instructed by a material instruction switch 102 of the recording member provided for the image forming apparatus may be employed as the material information 31. Fed paper detection means 28 and 29, such as lever switches, are disposed in the recording member conveyance passage to detect passage of the recording member so as to transmit information 32 about number of the recording members to oil apply control means 111 of the CPU 110 of the image forming apparatus. On the other hand, the recording member 13 allowed to pass through the fixing means 20 is discharged to the outside of the apparatus through a paper discharge roller 33. Discharge detection means 34 such as a lever switch, is disposed at the outlet portion of the passage. A discharge detection means 34 detects discharge of the recording member and transmits printing mode information 35 to an oil apply control means 111 of the CPU 110 of the image forming apparatus. If the CPU is not supplied with a next printing command in a predetermined time from discharge of the recording member, the CPU determines that the mode is a single sheet printing operation and follows a predetermined sequence to complete the image forming operation and the fixing operation. If a next printing command has been supplied in the predetermined time, the CPU determines that the mode is the successive printing operation and follows a predetermined sequence to continue the image forming operation and the fixing operation. Therefore, discharge is detected and transmitted as printing mode information 35. Actually, it is information denoting whether operation mode is the single sheet printing operation or the successive printing operation.

The fixing means 20 will now be described. Although a heat roller fixing unit will now be described as an example, a belt-type fixing unit and a surf fixing unit may be employed. It is also suggested that the present invention be employed in any fixing unit requiring consumption of oil to avoid the offset phenomenon.

The fixing means 20 comprises a heating roller 36 having a heat generating means 37, such as a halogen lamp, a pressurizing roller 38 arranged to be brought into contact with it to form the nip portion, an oil supply means 39 for applying an offset preventive solution, such as silicon oil, to the surface of the heating roller in an appropriate quantity and an oil limiting means 40 for forming the applied oil into a uniform and thin layer. The heating roller 36 has a metal cylinder made of aluminum or the like having excellent heat conductivity; and an elastic layer formed on the metal cylinder and made of silicon or fluorine rubber to improve contact with the recording member. Moreover, a separation layer made of silicon or formed by PFA coating or PFA tube formed on the elastic layer in order to improve separation characteristic. Either of the elastic layer or the separation layer may be employed. The pressurizing roller 38 has an elastic layer made of silicon or fluorine rubber on a metal shaft thereof. A separation layer made of silicon or PFA may be formed on the elastic layer. The pressurizing roller 38 is pressed against the heating roller 36 by a known pressurizing means (not shown). The oil supply means 39 is an oil supply roller structured such that felt or the like made of heat resisting fiber is impregnated with an offset preventive material, such as dimethyl silicon oil, in an appropriate quantity and the felt is wound around a metal shaft. The oil supply means 39 has a predetermined life and detachably attached to the fixing means 20 so as to be changed to a new part if a fact that it is dead. Moreover, the oil supply means 39 is controlled by the oil application control means 111 so that contact and separation are permitted. As a result, the timing and the period in which oil is applied can be adjusted. The oil supply means 39 may have a structure such that the shaft is in the form of a hollow cylinder having small apertures to store oil which is arranged to be supplied to the outer felt layer. It may be an oil applying pad having a felt layer comprising heat resisting fiber impregnated with oil and disposed on a holder made of heat resisting resin so that the felt layer is pressed against the heating roller 36 to apply oil. Another structure may be employed in which oil is supplied from a cassette oil tank storing oil to an oil applying means comprising a felt or a roller by using a pump or the capillary phenomenon so as to apply oil to the surface of the heating roller 36. The oil limiting means 40 is disposed downstream from the oil supply means 39 in a direction of rotation of the heating roller 36 and structured such that a fluorine rubber blade is secured to a support member made of metal or the like.

Since the oil limiting means 40 is brought into contact with the heating roller 36 under a predetermined pressure by a pressuring means, such as a spring, the supplied oil layer is formed into a uniform and thin layer formed by a predetermined quantity. The pressure can be varied by the oil application control means 111. In accordance with color mode information 104, the pressure is reduced if the multicolor printing operation is performed. The quantity of oil to be applied is enlarged so as to improve the effect of preventing offset. On the other hand, a reset means 132 comprising a switch or the like which is operated when the oil supply means 39 is changed or when the user has changed the oil supply means 39 to a new part is mounted on the fixing means 20.

The oil application control means 111 in the CPU 110 of the image forming apparatus is supplied with information 32 about number of the recording members, printing mode information 35 and color mode information 104.

By using the supplied information, the timing and period in which the oil supply means 39 is brought into contact and separated are controlled to make the oil applying timing, oil applying period and the quantity of oil to be applied to predetermined values. Moreover, the limiting pressure of the oil limiting means 40 is controlled. Moreover, an oil controlled variable 120 is transferred to the calculating means 112. The calculating means 112 uses information 32 about number of the recording members and material information 31 of the recording member and information 32 about number of sheets, printing mode information 35 and color mode information 104 included in the oil controlled variable 120 and the ROM 114 to calculate predicted oil consumption wi 121 to transmit it to the integrated value storage means 113.

The integrated value storage means 113 adds the integrated value of the predicted oil consumption W (i−1) up to and including the previous printing (the i−1 th sheet), which is stored in the nonvolatile memory 115, and the predicted oil consumption wi to calculate a new integrated value of the predicted oil consumption W (i) 122 which is then updated and stored so as to be transmitted to the comparison means 116. Moreover, the integrated value storage means 113 stores the newly-obtained value in the nonvolatile memory 115.

The comparison means 116 compares predetermined value Z 118 set to correspond to the life of oil of the oil supply means 39 and the integrated value of the predicted oil consumption W 122. If the integrated value of the predicted oil consumption W 122 exceed the predetermined value 118, the output means 117 transmits a change signal, such as alarm sound, for urging the user to change the oil supply means 39. Then, the oil change display means 119 operates the display portion to urge the user to quickly change the oil supply means.

The operation of the image forming apparatus according to the present invention and having the above-mentioned structure will now be described with reference to a flow chart.

Figure 4:
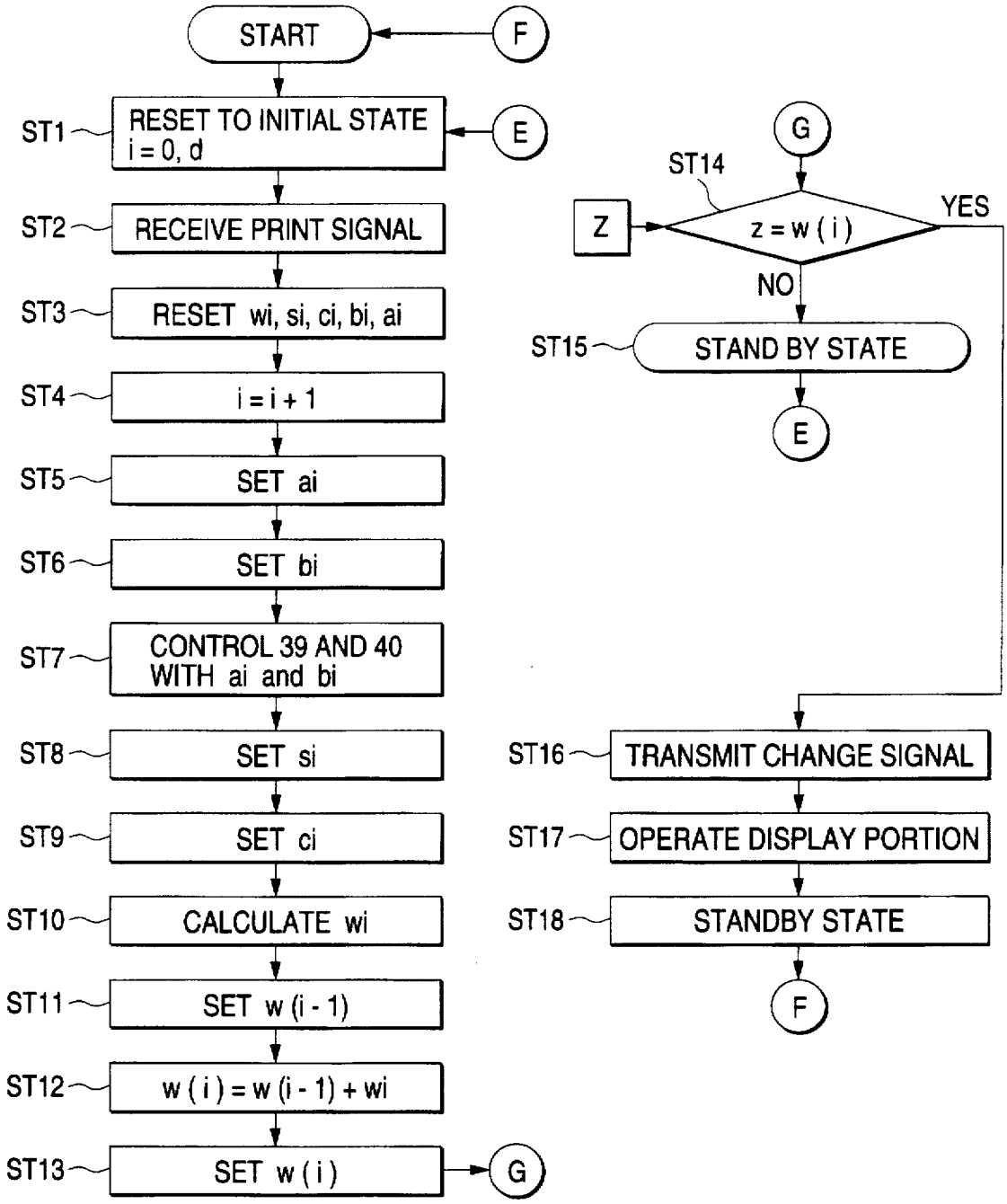
FIG. 4 is a flow chart showing the operation of the image forming apparatus according to the present invention.

FIG. 4 is a flow chart showing the flow of the operation of the image forming apparatus according to the present invention. After the power source has been turned on, the serial number i of the recording members in the CPU 110 is set to be zero and the oil evaporation rate d is set in step ST1 to perform initial setting. The CPU 110 receives the printing signal in step ST2 to cause the image forming apparatus to prepare for forming an image. In step ST3 wi, ai si, bi and ci in the CPU 110 are reset. In step ST4, the image forming process is started. In accordance with information 32 about number of recording members supplied from the fed paper detection means 28 and 29, the serial number i of the fed paper is increased such that i=i+1. In step ST5 color mode information 104 is supplied to the oil apply control means 111 in the CPU 110, and then ai is set from the ROM 114. In step ST6 information 32 about number of sheets and printing mode information 35 are supplied to the oil apply control means 111 in the CPU 110, and then bi is set from the ROM 114. In step ST7 the oil apply control means 111 controls the timing and the period in which the oil supply means 39 is brought into contact and separated to make the oil applying timing, the oil applying period and the quantity of oil to be applied to be predetermined values in accordance with set ai and bi. Moreover, the limiting pressure of the oil limiting means 40 is controlled. Then, the oil controlled variable 120 is transmitted to the calculating means 112. In step ST8 size information 30 is supplied to the CPU 110, and then si is set from the ROM 114. In step ST9 material information 31 is supplied to the CPU 110, and then ci is set from the ROM 114. In step ST10 the calculating means 112 in the CPU 110 calculates the predicted oil consumption wi at the i-th paper by wi=ai×(si×ci+(bi−si)×d), and then stores the result. In step ST11 the integrated value of the predicted oil consumption W (i−1) to the i−1 th sheet are read from the nonvolatile memory 115 so as to be set into the CPU 110. Note that setting is previously performed such that W (i−1)=0 at the delivery from the factory. In step ST12 the integrated value storage means 113 newly calculates integrated values of the predicted oil consumption W (i) to the i-th sheet such that W (i)=W (i−1)+wi to update the value so as to be stored. In step ST13 the integrated value of the predicted oil consumption W (i) is set to the nonvolatile memory 115. In step ST14 the comparison means 116 compares the predetermined value Z 118 corresponding to the life of oil of the oil supply means 39 and the integrated value of the predicted oil consumption W (i) to determine whether W (i) is larger than Z. If a determination has been performed that W (i) is smaller than Z, the operation follows the flow of NO. In step 15, sequential image forming process is completed, and then a standby state starts in which a next printing signal is waited for. If the printing signal has been supplied, the operation returns to step ST2 so that the next printing operation is continued. If a determination has been performed that W (i) is larger than Z, the operation follows the flow of YES so that the operation proceeds to step ST16 so that the output means 117 transmits a change signal, such as alarm signal, for urging the user to change the oil supply means 39. In step ST17 the oil change display means 119 operates the display portion to urge the user to quickly change the oil supply means. In step ST18 standby state starts. If the oil supply means has been changed, the standby state is suspended and the operation returns to step 1.

As described above, according to the structure of the present invention, the oil consumption in the fixing unit, which is changed in accordance with the recording member having various sizes and materials, the monochrome printing operation, the multicolor printing operation and the various printing modes can accurately and easily be predicted. Therefore, even if a small, compact and changeable oil supply means is employed, an appropriate change time can be alarmed and displayed with respect to a user to urge the user to quickly change the oil supply means.

Therefore, since the oil consumption can accurately be predicted, the oil supply means can be used until it is dead. Thus, an economical advantage can be obtained. Since change can be performed at an appropriate timing, a problem in that a user must perform wasteful change can be solved and the number of changing operations can be decreased. Since appropriate change is displayed, the complicated task for the user to confirm the number of sheets or check the quantity of residual oil can be reduced. Since the consumption of oil can be predicted accurately, a problem that the apparatus cannot be used suddenly although the user considers the apparatus can be used moreover or abnormal printing, such as offset, can be prevented. As a result, the reliability of the apparatus can be improved.

The structure and operation of another embodiment of the image forming apparatus according to the present invention will now be described with reference to FIGS. 5 and 6.

Figure 5:
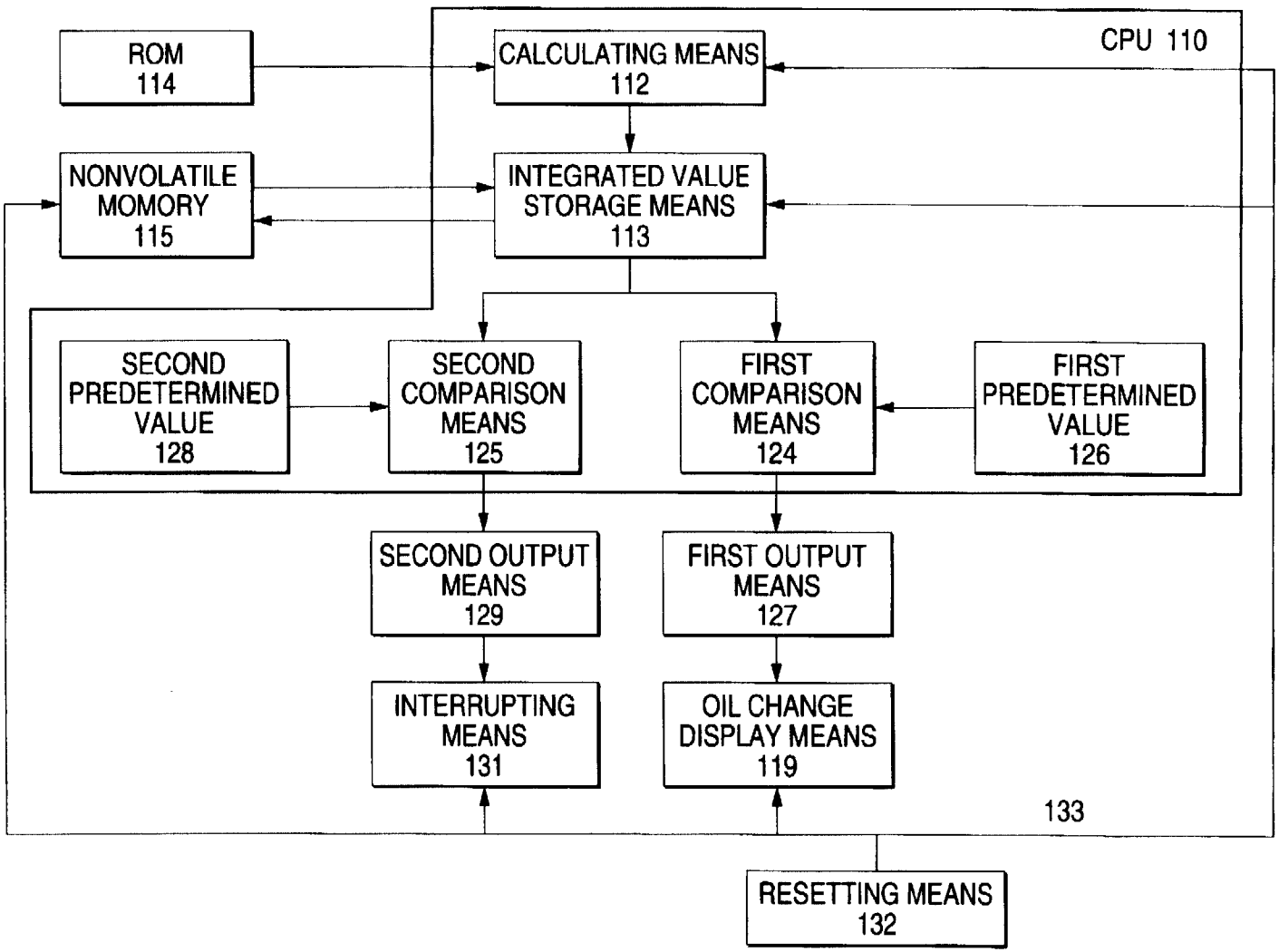
FIG. 5 is a block diagram showing the structure of another embodiment of the image forming apparatus according to the present invention.

FIG. 5 is a block diagram showing the structure of the other embodiment of the image forming apparatus according to the present invention. Referring to FIG. 5, the structure in the CPU 110 will now be described in main. The operations of the other structures are the same as those shown in FIG. 3. The integrated value storage means 113 adds the integrated value of the predicted oil consumption W (i−1) to the previous printing (the i−1 th sheet) stored in the nonvolatile memory 115 by the predicted oil consumption wi to calculate new integrated values of the predicted oil consumption W (i) 122 to update and store the same so as to transmit the same to a first comparison means 124 and a second comparison means. Moreover, it store the foregoing value in the nonvolatile memory 115. The first comparison means 124 compares first predetermined value Z1 (126) obtained by subtracting a predetermined margin from the life of the oil in the oil supply means 39 and the integrated value of the predicted oil consumption W 122. If the integrated value of the predicted oil consumption W 122 exceed the first predetermined value Z1 (126), the first output means 127 transmits a change signal having a relatively small volume and urging the user to change the oil supply means 39. The oil change display means 119 causes the display portion to flash to urge the user to quickly change the oil supply means. The second comparison means 125 compares second predetermined value Z2 (128) corresponding to the life of oil in the oil supply means 39 and the integrated value of the predicted oil consumption W 122. If the integrated value of the predicted oil consumption W 122 exceed the second predetermined value Z2 (128), a second output means 129 transmits an interruption signal, such as alarm sound having a large volume, to notify the user of the interruption of the operation of the image forming apparatus. Then, an interrupting means 131 interrupts the operation of the image forming apparatus. A reset means 132 comprising a switch or the like which is operated when the oil supply means 39 has been changed or which is operated by a user when the user has changed the reset means 132 to a new part is mounted on the fixing means 20. The reset means 132 corresponds to the change operation to transmit a reset signal 133 to the CPU 110. The reset signal 133 suspends and restores the operations of the interrupting means 131 and the oil change display means 119 in the CPU 110. Moreover, the reset signal resets, to initial states, the integrated value storage means 113, the nonvolatile memory 115, the calculating means 112 and the like.

Figure 6:
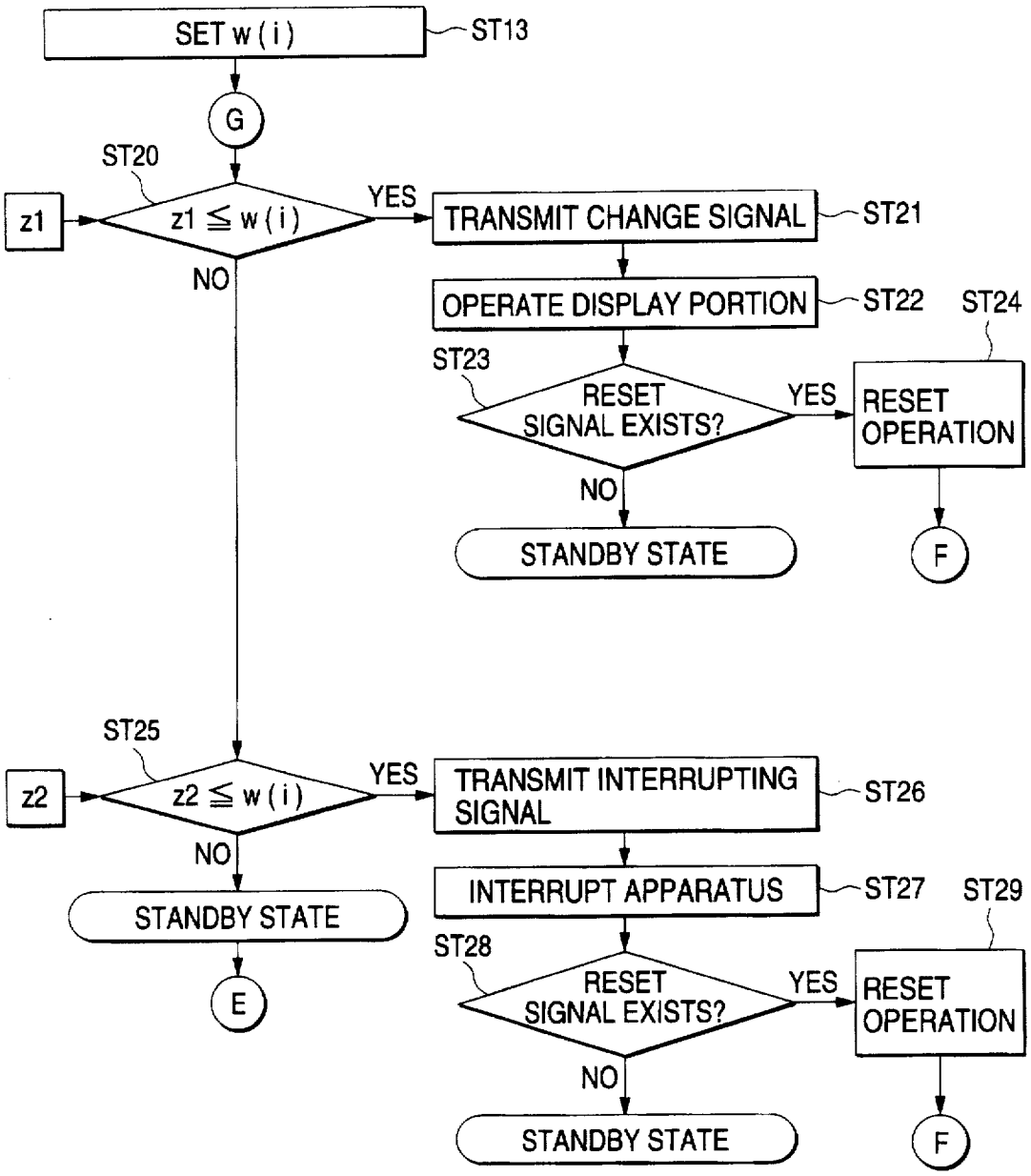
FIG. 6 is a flow chart showing the operation of the image forming apparatus according to another embodiment of the present invention.

FIG. 6 is a flow chart showing the operation of the other embodiment of the image forming apparatus according to the present invention. Referring to FIG. 6, flow from state G will now be described. Although the operations before step ST13 are omitted, they are similar to the operations and steps shown in FIG. 4. In step ST13 the integrated value of the predicted oil consumption W (i) is set to the nonvolatile memory 115. In step 20 the first comparison means 124 compares the first predetermined value Z1 (126) obtained by subtracting a predetermined margin from the life of oil in the oil supply means 39 and the integrated value of the predicted oil consumption W (i) to determine whether W (i) is larger than Z1. If a determination has been performed that W (i) is larger than Z1, the operation follows the flow of YES so that operation proceeds to step ST21 so that the first output means 127 transmits a change signal having a relatively small volume to urge the user to change the oil supply means 39. In step ST22 the oil change display means 119 causes the display portion to flash to urge the user to quickly change the oil supply means. In step ST23 whether the user has changed the oil supply means 39 to a new part and the reset signal 133 has been transmitted from the reset means 132 is determined. If the reset signal has been transmitted, the operation follows the flow of YES. In step ST24 a resetting operation is performed to suspend the display performed by the oil change display means 119. Then, the operation returns to step ST1. If the reset signal has not been transmitted, a standby state starts. If a determination has been in step 20 that W (i) is less than Z1, the operation follows the flow of NO so that the operation proceeds to step ST25. In step ST25 the second comparison means 125 compares the second predetermined value Z2 (128) corresponding to the life of oil in the oil supply means 39 and the integrated value of the predicted oil consumption W (i) to determine whether W (i) is larger than Z2. If a determination has been performed that W (i) is larger than Z2, the operation follows the flow of YES so that the operation proceeds to step ST26 so that the second output means 129 transmits an interruption signal, such as an alarm signal, having a relatively large volume, to notify the user of the interruption of the operation of the image forming apparatus. In step ST27 the interrupting means 131 interrupts the image forming apparatus to wait for quick change of the oil supply means by the user. In step ST28 whether or not the user has changed the oil supply means 39 to a new part and the reset signal 133 has been transmitted from the reset means 132 is determined. If the reset signal has been transmitted, the operation follows the flow of YES so that resetting operation is performed in step ST29 in which the interrupting means 131 is interrupted to restore the operation of the image forming apparatus and bring the integrated value storage means 113, the nonvolatile memory 115, the calculating means 112 and the like to initial states. Then, the operation returns to step ST1. If the reset signal has not been transmitted, a standby state starts so that a next printing signal is waited for. When the printing signal has been supplied, the operation returns to step ST2 so that the next printing operation is continued.

As described above, according to the structures and operations of the present invention, the oil consumption can accurately be predicted and a fact that the oil supply means is substantially dead is notified to a user before the death. Therefore, the user is urged to quickly change the oil supply means. Since the image forming apparatus is interrupted by the interrupting means after images have been printed and fixed in a predetermined quantity even after change of the oil supply means has been displayed, the problem in that the user does not stop use although oil has been consumed and therefore paper is wound around the roller, thus causing a jam to take place or smoke generation can be prevented. Therefore, the mechanical reliability of the image forming apparatus can be improved.

SUMMARY

As described above, according to the present invention, the oil consumption of the detachable oil supply means is predicted as an integrated value of the predicted oil consumption for each sheet fed. The prediction for each sheet may be based on the maximum information available, as in the first embodiment, or a subset of the information, as in the second embodiment.

The integrated value of the predicted oil consumption may usefully be employed by comparing it with one or more predetermined threshold values. When consumption exceeds a threshold, various effects may be caused. For example, the display may urge the user to change the oil supply. Another possible effect is the interruption of operation. Other effects are possible, and fall within the spirit and scope of the invention.

The invention may be used in any image forming apparatus in which a substance is used to avoid the offset phenomenon.

Although the description above contains many specificities, these should not be construed as limiting the scope of the invention but merely as providing illustrations of some of the presently preferred embodiments of this invention. For example, the information used in predicting the oil consumption may be augmented by additional information, or may be simplified by using a particular subset of the available information. The calculation may be performed in various ways, including more or less reliance on retrieving pre-stored values from memory, etc.

Thus, the scope of the invention should be determined by the appended claims and their legal equivalents, rather than by the examples given.

There is claimed:

1. An image forming apparatus, comprising:

image forming means for forming a toner image on an electrostatic latent image holding member, transfer means for transferring said toner image onto a current one of a plurality of recording members, fixing means for fixing said toner image to said current one of said plurality of recording members with a heated rotational member, paper feeding means for feeding said plurality of recording members, a recording member conveyance passage for conveying said plurality of recording members to said transfer means and to said fixing means, oil supply means for supplying oil to said heated rotational member, calculating means for calculating, with respect said current one of said plurality of recording members, a current recording member oil consumption prediction, integrated value storage means for storing an integrated value of said current recording member oil consumption prediction for each of said plurality of recording members, comparison means for comparing said integrated value with a predetermined value, and output means for transmitting a change signal to change the oil supply means when said integrated value exceeds said predetermined value;

wherein said current recording member oil consumption prediction is calculated based on consumption information that comprises at least one of:

size information pertaining to said current one of said plurality of recording members, material information pertaining to said current one of said plurality of recording members, printing mode information that indicates one of single sheet printing and continuous printing, and color mode information that indicates one of single and plural color mode.

2. An image forming apparatus according to claim 1, wherein said integrated value is expressed by:

$$W = \sum_{i=1}^{n} wi = \sum_{i=1}^{n} ai \times (si \times ci + (bi - si) \times d),$$

where

W=said integrated value (mg), n=a number pertaining to ones of said plurality of recording members that have been fed, i=a sequential number of said current one of said plurality of recording members, wi=said current recording member oil consumption prediction, ai=an amount (mg/cm$^2$) of said oil that is applied per unit area of said heated rotational member, said amount being based on said color mode information, si=an area of said current one of said plurality of recording members (cm$^2$), bi=an area of said heated rotational member to which said oil is applied (cm$^2$), ci=a respective oil absorption rate of said current one of said plurality of recording members, and d=an evaporation rate of said oil.

3. An image forming apparatus according to claim 1 or 2, wherein:

said comparison means comprises first comparison means and second comparison means;

said predetermined value includes a first predetermined value and a second predetermined value;

said output means comprises first output means and second output means;

when said first comparison means determines that said integrated value indicates that said first predetermined value has been exceeded, said first output means transmits a change signal to change the oil supply means;

when said second comparison means determines that said integrated value indicates that said second predetermined value has been exceeded, said second output means transmits an interruption signal to interrupt said image forming apparatus.

4. An image forming apparatus according to any one of claims 1 and 2, further comprising resetting means that detects the change of said oil supply means and, in response thereto, (a) resets said integrated value and (b) enables operation of said image forming apparatus.

5. In an image forming apparatus having a fixing unit for fixing images on recording members by performing fixing operations, a current one of said images being disposed on a current one of said recording members and fixed thereon in a current one of said fixing operations, a method for preventing offset comprising the steps of:

providing said image forming apparatus with a replaceable source having a supplied amount of offset preventive solution;

for said current one of said fixing operations, applying some of said supplied amount to said fixing unit, and determining a respective currently consumed amount of said offset preventive solution;

for said fixing operations, accumulating each said respective currently consumed amount as an integrated consumption value; and replacing said replaceable source based on said integrated consumption value and said supplied amount.

6. The method for preventing offset according to claim 5, wherein said currently consumed amount is determined based on size information pertaining to said current one of said recording members.

7. The method for preventing offset according to claim 5, wherein said currently consumed amount is determined based on material information pertaining to said current one of said recording members.

8. The method for preventing offset according to claim 5, wherein said currently consumed amount is determined based on printing mode information indicating one of single sheet and continuous printing.

9. The method for preventing offset according to any one of claims 5, 6, 7, or 8, wherein said currently consumed amount is determined based on color mode information indicating one of a single and a plural color mode.

10. The method for preventing offset according to claim 5, wherein said integrated consumption value is determined by:

$$W = \sum_{i=1}^{n} wi = \sum_{i=1}^{n} ai \times (si \times ci + (bi - si) \times d),$$

where

W=said integrated consumption value (mg), n=said recording members for which said fixing operations have been performed, i=a sequential number of said current one of said recording members, wi=said currently consumed amount, ai=a per unit area value at which said offset preventive solution is applied to said fixing unit for said current one of said fixing operations, and based on color mode information, si=an area value for said current one of said recording members, bi=an area upon which said offset preventive solution for said current one of said fixing operations is applied, ci=a respective absorption rate of said current one of said recording members, and d=an evaporation rate of said offset preventive solution.

11. The method for preventing offset according to any of claims 5, 6, 7, 8 or 10, further comprising the steps of:

issuing a change signal when said integrated consumption value passes a first threshold; and issuing an interruption signal when said integrated consumption value passes a second threshold which is between a value based on said supplied amount and said first threshold.

12. The method for preventing offset according to claim 11, wherein said replacing step includes the steps of:

resetting said integrated consumption value; and when said image forming apparatus is disabled due to said interruption signal, enabling said image forming apparatus.

13. An image forming apparatus according to claim 3, further comprising:

resetting means for detecting the change of said oil supply means and, in response to detecting the change of said oil supply means, resetting said integrated value and enabling operation of said image forming apparatus.

14. The method for preventing offset according to claim 9, further comprising the steps of:

issuing a change signal when said integrated consumption value passes a first threshold; and issuing an interruption signal when said integrated consumption value passes a second threshold which is between a value based on said supplied amount and said first threshold.

15. The method for preventing offset according to claim 14, wherein said replacing step includes the steps of:

resetting said integrated consumption value; and when said image forming apparatus is disabled due to said interruption signal, enabling said image forming apparatus.

* * * * *